US010752973B2

(12) United States Patent
Abe et al.

(10) Patent No.: US 10,752,973 B2
(45) Date of Patent: Aug. 25, 2020

(54) FERRITE-BASED STAINLESS STEEL WITH HIGH RESISTANCE TO CORROSIVENESS CAUSED BY EXHAUST GAS AND CONDENSATION AND HIGH BRAZING PROPERTIES AND METHOD FOR MANUFACTURING SAME

(71) Applicant: NIPPON STEEL & SUMIKIN STAINLESS STEEL CORPORATION, Tokyo (JP)

(72) Inventors: Masatoshi Abe, Hikari (JP); Junichi Hamada, Hikari (JP); Nobuhiko Hiraide, Hikari (JP); Norihiro Kanno, Hikari (JP); Shigeo Fukumoto, Shunan (JP); Shigeru Kaneko, Hikari (JP); Atsutaka Hayashi, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 0 days.

(21) Appl. No.: 16/368,260

(22) Filed: Mar. 28, 2019

(65) Prior Publication Data

US 2019/0226047 A1 Jul. 25, 2019

Related U.S. Application Data

(62) Division of application No. 15/504,750, filed as application No. PCT/JP2015/080751 on Oct. 30, 2015.

(30) Foreign Application Priority Data

Oct. 31, 2014 (JP) ..... 2014-222201
Oct. 27, 2015 (JP) ..... 2015-210741

(51) Int. Cl.

| | |
|---|---|
| ***C21D 9/46*** | (2006.01) |
| ***C22C 38/00*** | (2006.01) |
| ***C22C 38/38*** | (2006.01) |
| ***C22C 38/60*** | (2006.01) |
| ***C21D 6/00*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(Continued)

(52) U.S. Cl.

CPC ..... *C21D 9/46* (2013.01); *C21D 6/002* (2013.01); *C21D 8/0205* (2013.01); *C21D 8/0236* (2013.01); *C21D 8/0273* (2013.01); *C22C 38/00* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01)

(58) Field of Classification Search

None

See application file for complete search history.

(56) References Cited

U.S. PATENT DOCUMENTS 5,986,205 A * 11/1999 Matsune ..... B21B 1/227 136/243
8,721,960 B2 5/2014 Hatano et al.

(Continued)

FOREIGN PATENT DOCUMENTS

CN 102131946 A 7/2011
CN 102791899 A 11/2012

(Continued)

OTHER PUBLICATIONS

Chinese Office Action and Search Report for counterpart Application No. 201580047756.4, dated Jan. 2, 2018, with an English translation.

Extended European Search Report, dated Aug. 7, 2018, for corresponding European Application No. 15855321.4.

International Preliminary Report on Patentability (forms PCT/IPEA/409 and PCT/IPEA/416), dated Dec. 20, 2016, for corresponding International Application No. PCT/JP2015/080751, with an English translation.

(Continued)

*Primary Examiner* — Jenny R Wu

(74) *Attorney, Agent, or Firm* — Birch, Stewart, Kolasch & Birch, LLP

(57) ABSTRACT

This ferritic stainless steel contains, by mass %, C: 0.001% to 0.030%; Si: 0.01% to 1.00%. Mn: 0.01% to 2.00%, P: 0.050% or less, S: 0.0100% or less, Cr: 11.0% to 30.0%, Mo: 0.01% to 3.00%, Ti: 0.001% to 0.050%, Al: 0.001% to 0.030%, Nb: 0.010% to 1.000%, and N: 0.050% or less, with a remainder being Fe and inevitable impurities, wherein an amount of Al, an amount of Ti, and an amount of Si (mass %) satisfy Al/Ti≥8.4Si-0.78.

8 Claims, 1 Drawing Sheet

(51) Int. Cl.

| | |
|---|---|
| ***C22C 38/50*** | (2006.01) |
| ***C22C 38/52*** | (2006.01) |
| ***C22C 38/54*** | (2006.01) |

(56) References Cited

U.S. PATENT DOCUMENTS

| | | | | |
|---|---|---|---|---|
| 9,238,855 | B2 | 1/2016 | Sakamoto et al. | |
| 2003/0012974 | A1 | 1/2003 | Iwami et al. | |
| 2010/0272594 | A1 | 10/2010 | Hiraide | |
| 2011/0033731 | A1* | 2/2011 | Kawano | B23K 35/302 428/685 |
| 2011/0176953 | A1 | 7/2011 | Hiraide et al. | |
| 2011/0265920 | A1 | 11/2011 | Hatano et al. | |
| 2012/0085513 | A1 | 4/2012 | Oku et al. | |
| 2013/0004361 | A1 | 1/2013 | Sakamoto et al. | |
| 2013/0337289 | A1* | 12/2013 | Hatano | C22C 38/001 428/685 |
| 2015/0292068 | A1 | 10/2015 | Teraoka et al. | |
| 2015/0328706 | A1 | 11/2015 | Nagase et al. | |

FOREIGN PATENT DOCUMENTS

| | | | | |
|---|---|---|---|---|
| EP | 1 227 168 | A1 | 7/2002 | |
| EP | 1 818 422 | A1 | 8/2007 | |
| EP | 1818421 | A1 | 8/2007 | |
| EP | 2 166 120 | A1 | 3/2010 | |
| EP | 2 224 030 | A1 | 9/2010 | |
| EP | 2 351 868 | A1 | 8/2011 | |
| EP | 2 554 701 | A1 | 2/2013 | |
| EP | 2 639 325 | A1 | 9/2013 | |
| GB | 2 335 439 | A | 9/1999 | |
| JP | 7-268485 | A | 10/1995 | |
| JP | 8-60243 | A | 3/1996 | |
| JP | 2857767 | B2 | 2/1999 | |
| JP | 2001-26855 | A | 1/2001 | |
| JP | 3350499 | B2 | 11/2002 | |
| JP | 2002-363712 | A | 12/2002 | |
| JP | 2004-323907 | A | 11/2004 | |
| JP | 2008-190003 | A | 8/2008 | |
| JP | 2009-7663 | A | 1/2009 | |
| JP | 2009-174040 | A | 8/2009 | |
| JP | 2009-174046 | A | 8/2009 | |
| JP | 2009-197293 | A | 9/2009 | |
| JP | 2009-235555 | A | 10/2009 | |
| JP | 2009-299182 | A | 12/2009 | |
| JP | 2010-65278 | A | 3/2010 | |
| JP | 2010-121208 | A | 6/2010 | |
| JP | 2010-248625 | A | 11/2010 | |
| JP | 2010-285683 | A | 12/2010 | |
| JP | 2011-157616 | A | 8/2011 | |
| JP | 2011-174152 | A | 9/2011 | |
| JP | 2012-177157 | A | 9/2012 | |
| JP | 2013-209745 | A | 10/2013 | |
| JP | 2014-145097 | A | 8/2014 | |
| JP | 2014145097 | A * | 8/2014 | |
| JP | 2015-145531 | A | 8/2015 | |
| JP | 5788946 | B2 | 10/2015 | |
| KR | 10-2014-0082347 | A | 7/2014 | |
| WO | WO 2009/041430 | A1 | 4/2009 | |
| WO | WO 2011/114964 | A1 | 9/2011 | |
| WO | WO 2012/086706 | A1 | 6/2012 | |
| WO | WO-2012124528 | A1 * | 9/2012 | C22C 38/001 |
| WO | WO 2013/146881 | A1 | 10/2013 | |
| WO | WO 2014/069543 | A1 | 5/2014 | |
| WO | WO 2014/157576 | A1 | 10/2014 | |
| WO | WO 2014/157578 | A1 | 10/2014 | |

OTHER PUBLICATIONS

International Search Report (form PCT/ISA/210), dated Jan. 19, 2016, for corresponding International Application No. PCT/JP2015/080751, with an English translation.

Japanese Notification of Information Statement, dated Mar. 14, 2017, for corresponding Japanese Application No. 2015-210741, with an English translation.

Korean Office Action (Notice of Allowance) dated Jan. 29, 2019, for Counterpart Korean Application No. 10-2017-7005854, with an English translation.

Korean Office Action, dated Jun. 19, 2018, for corresponding Korean Application No. 10-2017-7005854, with an English translation.

Partial European Search Report for counterpart Application No. EP 15855321.4, dated Mar. 26, 2018.

The Japan Society for Technology of Plasticity, "Manufacturing and Working of New Plate Material Such as Composite Plate," The 117th Plastic Working Symposium, Sep. 12, 1988, pp. 1-10 (15 pages total), with a partial English translation.

Non-Final Office Action dated Mar. 22, 2019, issued in U.S. Appl. No. 15/504,750.

U.S. Office Action, dated Sep. 6, 2019, for U.S. Appl. No. 15/504,750.

* cited by examiner

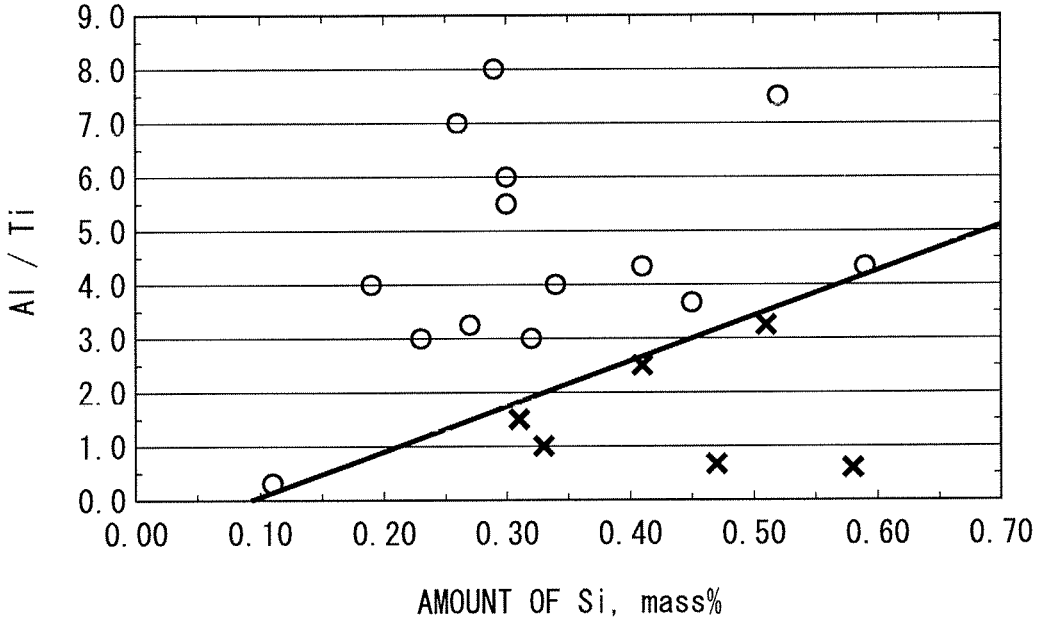
9.0
8.0
7.0
6.0
5.0
4.0
3.0
2.0
1.0
0.0
Al / Ti
0.00
0.10
0.20
0.30
0.40
0.50
0.60
0.70
AMOUNT OF Si, mass%

FERRITE-BASED STAINLESS STEEL WITH HIGH RESISTANCE TO CORROSIVENESS CAUSED BY EXHAUST GAS AND CONDENSATION AND HIGH BRAZING PROPERTIES AND METHOD FOR MANUFACTURING SAME

This application is a Divisional of U.S. application Ser. No. 15/504,750, filed Feb. 17, 2017, which is the U.S. National Phase of PCT/JP2015/080751, filed Oct. 30, 2015, which claims priority under 35 U.S.C. 119(a) to Japanese Application No. 2014-222201, filed Oct. 31, 2014 and Japanese Application No. 2015-210741, filed Oct. 27, 2015, the contents of all of which are incorporated by reference, in their entirety, into the present application.

TECHNICAL FIELD

The present invention relates to a ferrite-based stainless steel (ferritic stainless steel sheet) that is used in exhaust gas-condensate environments (environments of exhaust gas condensate water) and a method for manufacturing the same. Examples of members that are exposed to exhaust gas-condensate environments include automobile mufflers, exhaust heat recovery devices, and exhaust gas recirculation apparatuses such as exhaust gas recirculation (EGR) coolers.

BACKGROUND ART

Recently, in the automotive field, individual components included in exhaust gas have acted as causes of air pollution and environmental pollution, and thus tightening of regulations has been underway. Therefore, in order to decrease the amount of $CO_2$ exhausted from automobiles and improve gas mileage, not only improvement in engine efficiencies by means of high-efficiency combustion, idling stop function, and the like and weight reduction by means of material substitution, but also improvements by means of energy source diversification due to the usage of hybrid electric vehicles (HEV), biofuel vehicles, hydrogen/fuel cell vehicles (FCV), electrical vehicles (EV), and the like have become necessary.

Regarding these requirements, efforts have also made to improve gas mileage by mounting a heat exchanger that recovers exhaust heat, that is, an exhaust heat recovery device mainly in hybrid electric vehicles. In the exhaust heat recovery device, exhaust gas heat is transferred to cooling water by means of a heat exchange, and heat energy is recovered and reused; and as a result, the temperature of the cooling water is increased. Thereby, performance for heating the inside of vehicles is improved, and gas mileage performance is improved by shortening the time required for warming up engines. The exhaust heat recovery devices are also referred to as exhaust heat recirculation systems.

In addition, other efforts to install an exhaust gas recirculation apparatus that recirculates exhaust gas have also been made. Examples of the exhaust gas recirculation apparatuses include EGR coolers. In the EGR cooler, exhaust gas from engines is cooled using engine cooling water or air, and then the cooled exhaust gas is returned to the intake side and is re-combusted. Thereby, the combustion temperature is lowered, and the amount of $NO_X$ which is harmful gas is decreased.

For heat exchange portions in the above-described exhaust heat recovery devices or EGR coolers, a favorable heat efficiency is required, and a favorable thermal conductivity is required. In addition, high corrosion resistance against exhaust gas condensate water is required because the portions come into contact with exhaust gas. Particularly, since engine cooling water flows through these parts, in the case where holes are generated due to corrosion, there may be a risk of serious accidents. In addition, materials being used have a thin sheet thickness in order to increase the heat exchange efficiency. Therefore, materials having higher corrosion resistance than that of members in the downstream portion of exhaust systems are required.

Conventionally, among members mainly including mufflers in the downstream portion of exhaust systems, for portions particularly requiring corrosion resistance, a ferritic stainless steel containing 17% or more of Cr such as SUS430LX, SUS436J1L, or SUS436L has been used. For materials of exhaust heat recovery devices or EGR coolers, corrosion resistance that is higher than or equal to that of the above-described ferritic stainless steel is required.

In addition, EGR coolers are, generally, assembled by brazing, and thus parts being used need to have high brazing properties (brazeability). Here, in order to improve brazeability, the wettability of the surfaces is important. Ti is more easily oxidized than Fe and Cr and Ti forms an oxide film with poor wettability on the surface. Therefore, the amount of Ti is desirably set to be low. Furthermore, similar to Ti, Al forms an oxide film with poor wettability on the surface. Recently, there has been a demand for a steel in which the amount of Al as well as the amount of Ti is low. In addition, since the surface roughness of a steel sheet also has a great influence on wettability, it is also extremely important to control surface properties by controlling manufacturing conditions.

In addition, when the temperature of a brazing thermal treatment is high, the temperature reaches approximately 1,200° C., and, in this high-temperature environment, crystal grains in a stainless steel grow and coarsen. Since the coarsening of crystal grains has an influence on mechanical characteristics such as thermal fatigue and the like, a stainless steel on which a brazing thermal treatment is carried out needs to have characteristics in which crystal grains do not easily coarsen even at high temperatures.

As described above, a steel that is used in the EGR coolers needs to have high corrosion resistance and favorable brazeability.

Patent Document 1 discloses an inexpensive ferritic stainless steel material which is used as muffler-constituting members or water-warming device members that form welded portions and has high corrosion resistance. This ferritic stainless steel material contains C: 0.025% or less, Si: 2% or less, Mn: 1% or less, P: 0.045% or less, S: 0.01% or less, Cr: 16% to 25%, Al: less than 0.04%, and N: 0.025% or less, and further contains one or more element selected from Ni: 1% or less, Cu: 1% or less, Mo: less than 1%, Nb: 0.5% or less. Ti: 0.4% or less, and V: 0.5% or less, with a remainder of Fe and inevitable impurities. The ferritic stainless steel material has an oxide film in which the composition of an outermost layer contains a total amount of Si and Cr of 15 atom % to 40 atom % and 5 atom % of Fe in terms of the atomic ratio including oxygen on the surface, and the composition of the outermost layer is measured by an X-ray photoelectron spectrometry (XPS).

Patent Document 2 discloses a ferritic stainless steel with high brazeability in the case where the ferritic stainless steel is brazed in an environment of a high temperature and a low oxygen partial pressure as is the case with Ni brazing and Cu brazing. This ferritic stainless steel contains C: 0.03% or less, N: 0.05% or less, C+N: 0.015% or more, Si: 0.02% to 1.5%, Mn: 0.02% to 2%, Cr: 10% to 22%, Nb: 0.03% to 1%, and Al: 0.5% or less, with a remainder of Fe and inevitable impurities. Furthermore, the ferritic stainless steel contains an amount of Ti that satisfies Expression: Ti-3N≤0.03 and Expression: 10(Ti-3N)+Al≤0.5 or further contains, as a substitute for a part of Fe, one or more of Mo: 3% or less, Ni: 3% or less, Cu: 3% or less, V: 3% or less, W: 5% or less, Ca: 0.002% or less, Mg: 0.002% or less, and B: 0.005% or less.

Patent Document 3 discloses a ferritic stainless steel for a automobile exhaust system member having favorable resistance to initial rusting at a low cost without impairing the intrinsic functions of automobile exhaust system members such as high-temperature strength, resistance against scale spallation, formabiliy, corrosion resistance against exhaust gas condensate water, and corrosion resistance against salt damage environments. This ferritic stainless steel contains, by mass %, C: ≤0.0100%, Si: 0.05% to 0.80%, Mn: ≤0.8%, P: ≤0.050%, S: ≤0.0030%, Cr: 11.5% to 13.5%, Ti: 0.05% to 0.50%, Al: ≤0.100%, and N: ≤0.02% with a remainder of Fe and inevitable impurities. The number of inclusions containing Ca per square millimeter of an arbitrary cross-section is less than 10, and furthermore, preferably, the proportion of the number of Mn-based sulfides to the total number of Ti-based sulfides and the Mn-based sulfides is 50% or less.

Patent Document 4 discloses a ferritic stainless steel having excellent localized corrosion resistance. This ferritic stainless steel contains, by mass %, C: 0.030% or less, N: 0.030% or less, Si: 0.30% or less, Mn: 0.30% or less, P: 0.040% or less, S: 0.020% or less, Cr: 16% to 26%. Al: 0.015% to 0.5%, Ti: 0.05% to 0.50%, Nb: 0.05% to 0.50%, and Mo: 0.5% to 3.0%, with a remainder of Fe and inevitable impurities. When the ratio of the amount of Al to the amount of Si is represented by Al/Si, the following expression (1) is satisfied.

$$Al/Si \geq 0.10 \quad (1)$$

Patent Document 5 discloses a ferritic stainless steel with high corrosion resistance. This ferritic stainless steel contains, by mass %, C: 0.030% or less, N: 0.030% or less, Si: 0.01% to 0.50%, Mn: 1.5% or less, P: 0.04% or less. S: 0.01% or less, Cr: 12% to 25%, Nb: 0.01% to 1.0%, V: 0.010% to 0.50%, Ti: 0.60% or less, and Al: 0.80% or less, with a remainder of Fe and inevitable impurities. The following expression (A) is satisfied, furthermore, polishing marks with an arithmetic average roughness value Ra of the surface in a range of 0.35 μm to 5.0 μm are provided, and the color difference L* value of the surface is 70 or more.

$$0.35 \leq Nb+5V \leq 2.0 \quad \text{Expression (A)}$$

However, the inventions disclosed by Patent Documents 1 to 5 are not capable of having both of excellent corrosion resistance against exhaust gas condensate water and excellent brazeability.

PRIOR ART DOCUMENTS

Patent Documents

Patent Document 1: Japanese Unexamined Patent Application, First Publication No. 2009-197293

Patent Document 2: Japanese Unexamined Patent Application, First Publication No. 2009-174046

Patent Document 3: Japanese Unexamined Patent Application, First Publication No. 2004-323907

Patent Document 4: Japanese Unexamined Patent Application, First Publication No. 2010-248625

Patent Document 5: Japanese Unexamined Patent Application, First Publication No. 2015-145531

DISCLOSURE OF THE INVENTION

Problems to be Solved by the Invention

The present invention aims to provide a ferrite-based stainless steel (ferritic stainless steel sheet) with high resistance to corrosiveness caused by exhaust gas and condensation (corrosion resistance against exhaust gas condensate water) and high brazing properties (brazeability) in environments in which the ferritic stainless steel is used for automobile mufflers, exhaust heat recovery devices, EGR coolers, or the like, and a method for manufacturing the same.

Means for Solving the Problem

The features of the present invention intended to solve the above-described problems is as described below.

(1) A ferritic stainless steel with high corrosion resistance against exhaust gas condensate water and high brazeability, containing, by mass %:

C: 0.001% to 0.030%;
Si: 0.01% to 1.00%;
Mn: 0.01% to 2.00%;
P: 0.050% or less;
S: 0.0100% or less;
Cr: 11.0% to 30.0%;
Mo: 0.01% to 3.00%;
Ti: 0.001% to 0.050%;
Al: 0.001% to 0.030%;
Nb: 0.010% to 1.000%; and
N: 0.050% or less, with a remainder being Fe and inevitable impurities, wherein an amount of Al, an amount of Ti, and an amount of Si (mass %) satisfy Al/Ti≥8.4Si-0.78.

(2) The ferritic stainless steel with high corrosion resistance against exhaust gas condensate water and high brazeability according to (1), further containing, by mass %, any one or more of:

Ni: 0.01% to 3.00%;
Cu: 0.050% to 1.500%;
W: 0.010% to 1.000%;
V: 0.010% to 0.300%,
Sn: 0.005% to 0.500%,
Sb: 0.0050% to 0.5000%, and
Mg: 0.0001% to 0.0030%.

(3) The ferritic stainless steel with high corrosion resistance against exhaust gas condensate water and high brazeability according to (1) or (2), further containing, by mass %, any one or more of:

B: 0.0002% to 0.0030%;
Ca: 0.0002% to 0.0100%;
Zr: 0.010% to 0.300%;
Co: 0.010% to 0.300%,
Ga: 0.0001% to 0.0100%,
Ta: 0.0001% to 0.0100%, and
REM: 0.001% to 0.200%.

(4) The ferritic stainless steel with high corrosion resistance against exhaust gas condensate water and high brazeability according to any one of (1) to (3), wherein, when a rolling direction is represented by an L direction, a direction perpendicular to the rolling direction is represented by a C direction, a direction inclined at 45° with respect to the rolling direction is represented by a V direction, and arithmetic average roughness values of a steel surface in the respective directions are respectively represented by $Ra_L$, $Ra_C$, and $Ra_V$ (unit: μm), $(Ra_L+Ra_C+2Ra_V)/4 \leq 0.50$ and $|(Ra_L+Ra_C-2Ra_V)/2| \leq 50.10$ are satisfied.

(5) The ferritic stainless steel with high corrosion resistance against exhaust gas condensate water and high brazeability according to any one of (1) to (4), wherein an amount of change in grain size number (GSN) before and after a thermal treatment at 1,150° C. for 10 minutes in a vacuum atmosphere of 50 Pa or lower is 5.0 or less.

(6) The ferritic stainless steel with high corrosion resistance against exhaust gas condensate water and high brazeability according to any one of (1) to (5) which is used in automobile mufflers, exhaust heat recovery devices, and EGR coolers that are automobile parts exposed to exhaust gas-condensate environments.

(7) A method for manufacturing a ferritic stainless steel with high corrosion resistance against exhaust gas condensate water and high brazeability, the method including: a step of cold-rolling a steel having the chemical components according to any one of (1) to (3), wherein, in the cold rolling step, in a final pass, the steel is rolled using a roll with a roll roughness of #60 or more under conditions where a rolling reduction in the final pass is set to 15.0% or less and a cold rolling speed in the final pass is set to 800 m/min or less.

(8) The method for manufacturing a ferritic stainless steel with high corrosion resistance against exhaust gas condensate water and high brazeability according to (7), the method further including: a step of annealing a cold-rolled steel sheet, wherein the annealing step includes: a step of maintaining the steel sheet at a temperature of 650° C. to 950° C. for 5.0 s or longer; and a step of maintaining the steel sheet at a temperature of 950° C. to 1,050° C. for 80.0 s or shorter.

Effects of the Invention

According to the present invention, it is possible to provide a ferritic stainless steel with high corrosion resistance against exhaust gas condensate water and high brazeability in the case where the ferritic stainless steel is used in automobile parts exposed to exhaust gas-condensate environments (environments of exhaust gas condensate water) such as automobile mufflers, exhaust heat recovery devices, EGR coolers, or the like.

BRIEF DESCRIPTION OF THE DRAWINGS

FIG. 1 is a view showing a relationship between the amounts of Si, Al, and Ti in steel sheets and the results of the condensate water corrosion test.

EMBODIMENTS FOR CARRYING OUT THE INVENTION

Hereinafter, embodiments of the present invention will be described in detail with reference to the accompanying drawings.

In order to improve brazeability, the present inventors produced steels in which the amount of Al or the amount of Ti was decreased to a variety of concentrations under a variety of cold rolling conditions or a variety of annealing conditions of cold-rolled sheets. Then, corrosion resistance, brazeability, surface roughness, and an amount of change in crystal grain size before and after a brazing thermal treatment were investigated. As a result, it was found that the brazeability is improved as the concentration of Al or the concentration of Ti in a steel is decreased. However, regarding improvement of corrosion resistance against exhaust gas condensate water, no effects were developed in a method in which the concentration of Al or the concentration of Ti in a steel was simply decreased. It has been found that, when the balance among the concentration of Al, the concentration of Ti, and the concentration of Si is optimized, brazeability is improved, and corrosion resistance against exhaust gas condensate water is improved. Furthermore, detailed studies were made regarding geometric surface properties having an influence on the spreading of brazing filler metal. As a result, it was found that, in the case where the average values of surface roughness in a rolling direction, a direction perpendicular to the rolling direction, and a direction inclined at 45° with respect to the rolling direction are small, and the difference between the surface roughness values is small, the brazeability is further improved. In addition, it was found that the amount of change in crystal grain size before and after a brazing thermal treatment is decreased by controlling the annealing conditions of cold-rolled sheets and controlling the precipitation state of a Laves phase such as $Fe_2Nb$ and the like in a steel. Hereinafter, the study results by the inventors will be described.

Since automobile mufflers, exhaust heat recovery devices, and exhaust gas recirculation apparatuses such as EGR coolers are exposed to exhaust gas-condensate environments, there is a demand for corrosion resistance, particularly, corrosion resistance against exhaust gas condensate water (corrosion resistance against condensate water, resistance to condensate water corrosion). The present researchers produced steel sheets with a variety of compositions and carried out tests of corrosion resistance against condensate water. The results are shown in FIG. 1 in which the horizontal axis indicates the amount of Si in the steel sheet and the vertical axis indicates the amount ratio of Al/Ti in the steel sheet (both by mass %). Regarding the determination standard in the condensate water corrosion test, the maximum corrosion pit depth of 100 m was used as a boundary value, and 100 μm was the maximum corrosion pit depth of the sample in which the notable growth of corrosion pits was confirmed under the test conditions used in examples described below. A steel in which the maximum corrosion pit depth was 100 μm or more was evaluated as C (bad) and plotted with a reference sign "X" in FIG. 1. A steel in which the maximum corrosion pit depth was less than 100 μm was evaluated as B (good) and plotted with a reference sign "O" in FIG. 1. The solid line in FIG. 1 indicates Al/Ti=8.4Si-0.78.

From FIG. 1, it is found that, in the case where the amounts (mass %) of Al, Ti, and Si in a steel does not satisfy the relationship of Al/Ti=8.4Si-0.78, corrosion resistance against condensate water greatly degrades. From this result, it is found that the amounts of Al, Ti, and Si desirably satisfy the relationship of Al/Ti=8.4Si-0.78.

As a result of investigating inclusions present in a steel which did not satisfy the relationship of Al/Ti=8.4Si-0.78, it was found that, mainly, a Ti-based oxide was present. On the other hand, it was found that inclusions present in a steel which satisfied the relationship of Al/Ti=8.4Si-0.78 was mainly $Al_2O_3$—MgO. In addition, CaO—$Al_2O_3$ was present in a deformed form in the rolling direction so as to surround $Al_2O_3$.

Since the Ti-based oxide is a hard inclusion, the Ti-based oxide does not deform together with the base material during cold rolling, and voids are likely to be formed in the interfaces between the inclusions and the base material. The formed voids are considered to serve as starting points of pitting corrosion and degrade the corrosion resistance against condensate water of the steel.

$Al_2O_3$—MgO is also a hard inclusion, but it is considered that no voids are formed in the interfaces between the inclusions and the base material due to the deformation of CaO—$Al_2O_3$ in the rolling direction which is present in the vicinity of $Al_2O_3$—MgO, and the corrosion resistance against condensate water does not deteriorate.

In addition, Si increases the activity of Ti; and thereby, Si assists the generation of the Ti-based oxide. Therefore, it is desirable to decrease the amount of Si in, particularly, low-Al materials (materials with a small amount of Al).

As described above, when the relationship of Al/Ti=8.4Si-0.78 is satisfied, $Al_2O_3$—MgO inclusions which do not serve as starting points of corrosion are preferentially generated.

However, since Al, Ti, and Si are effective elements for deoxidation, in the case where the amounts of these elements are decreased, there is a concern of an increase in the concentration of O in the steel. In this case, Mg is added to perform deoxidation; and thereby, the formation of oxides in the steel is inhibited, and furthermore, it is possible to prevent the deterioration of corrosion resistance against condensate water.

Meanwhile, in order to improve brazeability, it is necessary to decrease the amounts of Al and Ti. Therefore, it is necessary to decrease the amounts of Al and Ti being added to a molten steel. In the case where the added amount of Al is decreased, the concentration of O in the molten steel increases, and the reaction of [S]+(CaO)→(CaS)+[O], which is a desulfurization reaction, does not proceed. Therefore, it is necessary to use low-S ferro chrome (with a small amount of S) as a raw material and decrease the concentration of S in the molten steel in advance.

In addition, Table 1 shows the relationships between the cold rolling conditions in the final pass and the arithmetic average roughness values in the respective directions and the brazeability. Steel Nos. in Table 1 are the same as Steel Nos. in Tables 3A to 3D shown below. Brazeability was evaluated as described below, 0.2 g of Ni brazing filler metal was placed on the surface of a steel sheet produced by a method described below and was heated at 1,200° C. for ten minutes in a vacuum atmosphere of $5\times10^{-3}$ torr. Next, the test specimen was cooled to normal temperature, and the area of the brazing filler metal (brazing filler metal area) in the heated test specimen was measured. A steel in which the brazing filler metal area after heating was 2.5 times or more the brazing filler metal area before heating was evaluated as A (excellent). A steel in which the brazing filler metal area after heating was 2 times (twice) or more to less than 2.5 times the brazing filler metal area before heating was evaluated as B (good). A steel in which the brazing filler metal area after heating was less than 2 times (twice) the brazing filler metal area before heating was evaluated as C (bad).

TABLE 1

| | | Final pass cold rolling conditions | | | Measurement results of brazeability and arithmetic average roughness value | | | | | |
|---|---|---|---|---|---|---|---|---|---|---|
| | Steel No. | Roll roughness No. | Rolling reduction % | Cold rolling speed m/min | Brazeability | $Ra_L$ μm | $Ra_C$ μm | $Ra_V$ μm | $(Ra_L + Ra_C + 2Ra_V)/4$ μm | $(Ra_L + Ra_C - 2Ra_V)/2$ μm |
| Invention Example | A1 | #600 | 11.1 | 500 | A | 0.14 | 0.16 | 0.16 | 0.16 | −0.01 |
| | A2 | #800 | 13.5 | 500 | A | 0.05 | 0.06 | 0.07 | 0.06 | −0.02 |
| | A3 | #80 | 8.5 | 800 | A | 0.11 | 0.10 | 0.09 | 0.10 | 0.02 |
| | A4 | #600 | 12.5 | 250 | A | 0.13 | 0.17 | 0.18 | 0.17 | −0.03 |
| | A4' | #60 | 6.4 | 500 | A | 0.43 | 0.44 | 0.42 | 0.43 | 0.02 |
| | A5 | #80 | 14.8 | 700 | A | 0.08 | 0.09 | 0.09 | 0.09 | −0.01 |
| | A6 | #800 | 5.3 | 480 | A | 0.03 | 0.04 | 0.02 | 0.03 | 0.02 |
| | A7 | #600 | 12.5 | 470 | A | 0.15 | 0.16 | 0.14 | 0.15 | 0.02 |
| | A8 | #80 | 12.4 | 350 | A | 0.09 | 0.10 | 0.11 | 0.10 | −0.02 |
| | A9 | #600 | 8.7 | 400 | A | 0.18 | 0.19 | 0.12 | 0.15 | 0.07 |
| | A10 | #600 | 9.9 | 340 | A | 0.11 | 0.16 | 0.23 | 0.18 | −0.10 |
| | A11 | #800 | 12.4 | 600 | A | 0.02 | 0.05 | 0.04 | 0.04 | −0.01 |
| | A12 | #60 | 11.7 | 320 | A | 0.41 | 0.45 | 0.47 | 0.45 | −0.04 |
| | A13 | #80 | 9.1 | 430 | A | 0.12 | 0.13 | 0.10 | 0.11 | 0.03 |
| | A14 | #800 | 12.4 | 500 | A | 0.03 | 0.04 | 0.05 | 0.04 | −0.02 |
| | A15 | #40 | 12.4 | 750 | B | 0.53 | 0.51 | 0.49 | 0.51 | 0.03 |
| | A16 | #600 | 15.9 | 450 | B | 0.49 | 0.59 | 0.47 | 0.51 | 0.07 |
| | A17 | #80 | 13.5 | 850 | B | 0.31 | 0.74 | 0.71 | 0.62 | −0.19 |
| | A20 | #600 | 15.3 | 396 | B | 0.49 | 0.68 | 0.53 | 0.56 | 0.05 |
| | A21 | #60 | 16.1 | 900 | B | 0.65 | 0.92 | 0.89 | 0.84 | −0.11 |
| | A22 | #800 | 14.9 | 870 | B | 0.74 | 0.77 | 0.86 | 0.81 | −0.11 |

From Table 1, it is found that, in the case where the following conditions (1) to (3) are satisfied, either one or both of the absolute value of $(Ra_L+Ra_C+2Ra_V)/4$ and the absolute value of $(Ra_L+Ra_C-2Ra_V)/2$ decrease, and brazeability is improved.

(1) The roughness of a roll being used in the final pass of cold rolling is set to #60 or more.

(2) The rolling reduction in the final pass is set to 15.0% or less.

(3) The cold rolling speed in the final pass is set to 800 m/min or less.

Particularly, it is found that, in the case where $(Ra_L+Ra_C+2Ra_V)/4\leq0.50$ and $|(Ra_L+Ra_C-2Ra_V)/2|\leq0.10$ are satisfied, brazeability is improved. Preferably, $(Ra_L+Ra_C+2Ra_V)/4\leq0.30$ and $|(Ra_L+Ra_C-2Ra_V)/2|\leq0.05$ are satisfied. The smaller the values of these indexes are, the more preferable it is: and therefore, it is not necessary to provide the lower limit values of these indexes. However, the lowest value of $(Ra_L+Ra_C+2Ra_V)/4$ which can be realistically achieved is 0.02, and the lowest value of $|(Ra_L+Ra_C-2Ra_V)/2|$ which can be realistically achieved is 0.005.

It is known that surface roughness has an extremely great influence on wettability. However, the surface of a stainless steel exhibits repellent against brazing filler metal, and there have been a number of indefinite points regarding the relationship between the two-dimensional surface properties of the surface of a stainless steel sheet and brazing filler metal being used for brazing or the spreading properties of brazing filler metal. As the surface of a stainless steel is roughened, the repellent against brazing filler metal increases; and therefore, brazeability become poor. In the present embodiment, it was found that a decrease in surface roughness in one direction does not sufficiently improve the two-dimensional spreading of brazing filler metal and the spreading properties of brazing filler metal can be extremely improved by controlling roughness on a sheet surface in multiple directions.

That is, when the average value of roughness on a sheet surface (in-plane roughness) is decreased and the difference in roughness on the sheet surface (in-plane roughness) is decreased, the two-dimensional spreading of brazing filler metal becomes easy (the brazing filler metal can easily spread in two-dimensional directions). Specifically, $(Ra_L+Ra_C+2Ra_V)/4$ is an index indicating the average value of arithmetic average roughness values in three directions, and $|(Ra_L+Ra_C-2Ra_V)/2|$ is an index indicating the difference between arithmetic average roughness values in three directions. Brazeability is improved by setting the average value of arithmetic average roughness values in three directions to be 0.50 or less and setting the difference between the arithmetic average roughness values in three directions to be 0.10 or less.

As a method for decreasing the values of $(Ra_L+Ra_C+2Ra_V)/4$ and $|(Ra_L+Ra_C-2Ra_V)/2|$, there is a method for controlling the pass schedule of the cold rolling step in a process for manufacturing a stainless steel sheet. In the cold rolling step of a stainless steel sheet, generally, multi-pass rolling is carried out using a Sendzimir rolling machine; and thereby, a stainless steel sheet with a predetermined sheet thickness is manufactured. At this time, paraffinum liquidum or water-soluble oil is used as a lubricant. In the present embodiment, the final pass is carried out under the above-described conditions (1) to (3). That is, the final pass is carried out using a roll with a roll roughness of #60 or more, the rolling reduction in the final pass is set to 15.0% or less, and the cold rolling speed in the final pass is set to 800 m/min or less. In such a case, preferred surface properties defined in the present embodiment are realized. In the multi-pass rolling using a Sendzimir rolling machine, a flat surface is formed by transferring cold rolling roll marks while eliminating defects (shot blast flaws, intergranular corrosion grooves, pickling pits, and the like) on the surface of a base material.

In the preferred surface properties defined in the present embodiment, the average value of arithmetic average roughness values in three directions and the difference between arithmetic average roughness values in three directions are smaller than predetermined values. In the case where the surface of a roll being used in the final pass is rough, the grinding marks of the roll are transferred, and the surface of a stainless steel also becomes rough, and thus, in the final pass, a roll with a roughness of #60 or more is used. The roll roughness is more desirably #80 or more. In the case where the roll roughness is more than #1,000, further improvement of the effect cannot be expected, and thus the roll roughness is desirably set to #1,000 or less.

In addition, when the rolling reduction in the final pass increases, the contact arc length between the steel sheet in a roll caliber tool and the roll becomes long, and thus it becomes difficult to discharge rolling oil from the roll caliber tool. In the case where the rolling oil is not easily discharged, the rolling oil in the roll caliber tool generates a hydrostatic pressure, and two-dimensional recesses are likely to be generated on the surface of the steel sheet. Thereby, the values of $(Ra_L+Ra_C+2Ra_V)/4$ and $|(Ra_L+Ra_C-2Ra_V)/2|$ are likely to increase. In addition, depending on the amount of rolling oil or the surface properties of the original sheet, a galling phenomenon called heat scratches occurs when the steel sheet is rolled at a high rolling reduction, and, conversely, the surface roughness becomes rough. In the present embodiment, the occurrence of heat scratches is prevented while accelerating the discharge of rolling oil in the roll caliber tool. Thereby, the difference between roughness values in the respective directions is decreased by decreasing the roughness values, particularly, in directions other than the rolling direction. In order to achieve what has been described above, the rolling reduction in the final pass is desirably set to 15.0% or less. The rolling reduction in the final pass is more desirably 14.5% or less, and, when productivity or steel sheet shapes are taken into account, the rolling reduction is desirably 10.0% or more. The rolling reduction in the final pass is more desirably 12.0% or more.

Additionally, the rolling speed (cold rolling speed) in the final pass in the present embodiment is desirably set to 800 m/min or less. In the inlet of the roll caliber tool, the rolling oil remains in surface recesses that remain in the rolled material, the oil is discharged in the roll caliber tool, and thus roll marks are transferred to the steel sheet. However, in the case where the rolling speed is fast, sufficient time is not obtained for discharging the oil, thus, recesses are insufficiently eliminated, and it becomes difficult to decrease the roughness, particularly, at recess portions. In order to sufficiently discharge the rolling oil in the recess portions, sufficiently transfer a flat roll in a two-dimensional manner, and reduce the anisotropy of roughness, the cold rolling speed in the final pass is desirably set to 800 m/min or less. The cold rolling speed in the final pass is more desirably 600 m/min or less and still more desirably 500 m/min or less. When productivity, steel sheet shapes, and surface gloss are taken into account, the cold rolling speed in the final pass is desirably 150 m/min or more.

Furthermore, other conditions in the cold rolling may be set in consideration of the sheet thickness or surface finishing of products, and, in the case where steel sheets are rolled in one direction using a tandem rolling machine which is an ordinary steel rolling machine, the conditions in the present embodiment may be applied to the final stand. In addition, the rolling oil may be paraffinum liquidum or water-soluble oil.

Table 2 shows the annealing conditions of the cold-rolled sheets and grain size numbers (GSN) before and after a brazing thermal treatment. Steel Nos, in Table 2 are the same as Steel Nos, in Tables 3A to 3D shown below. The grain size number was evaluated as described below. A steel sheet produced using a method described below was cut so that a surface parallel to the rolling direction could be observed and was implanted in a resin. The grain size number was measured using an optical microscope and a cutting method.

TABLE 2

| | Steel No. | Annealing conditions of cold-rolled sheet: Holding time at 650° C. to 950° C. s | Annealing conditions of cold-rolled sheet: Holding time at 950° C. to 1,050° C. s | Measurement results of GSN: GSN (before brazing thermal treatment) | Measurement results of GSN: GSN (after brazing thermal treatment) | ΔGSN |
|---|---|---|---|---|---|---|
| Invention Example | A1 | 8.0 | 75.0 | 7.2 | 4.2 | 3.0 |
| | A2 | 10.0 | 45.3 | 7.5 | 4.3 | 3.2 |
| | A3 | 9.0 | 65.5 | 7.1 | 4.3 | 2.8 |
| | A4 | 8.3 | 52.3 | 6.5 | 3.2 | 3.3 |
| | A4' | 8.6 | 65.1 | 6.4 | 3.4 | 3.0 |
| | A5 | 13.4 | 72.3 | 7.3 | 3.7 | 3.6 |
| | A6 | 12.7 | 40.9 | 7.6 | 3.0 | 4.6 |
| | A7 | 11.6 | 53.2 | 6.7 | 4.3 | 2.4 |
| | A8 | 10.5 | 49.7 | 6.2 | 4.1 | 2.1 |
| | A9 | 9.6 | 60.5 | 6.3 | 3.0 | 3.3 |
| | A10 | 5.3 | 26.9 | 7.2 | 3.5 | 3.7 |
| | A11 | 14.6 | 71.1 | 6.4 | 3.1 | 3.3 |
| | A12 | 17.3 | 39.5 | 6.4 | 3.2 | 3.2 |
| | A13 | 10.8 | 79.8 | 6.8 | 4.0 | 2.8 |
| | A14 | 7.4 | 65.3 | 7.4 | 3.3 | 4.1 |
| | A18 | 4.2 | 75.3 | 5.9 | 0.8 | 5.1 |
| | A19 | 16.2 | 83.5 | 5.8 | 0.6 | 5.2 |
| | A20 | 4.5 | 42.0 | 5.9 | 0.7 | 5.2 |
| | A21 | 4.8 | 86.3 | 5.4 | 0.3 | 5.1 |
| | A22 | 14.6 | 90.1 | 5.8 | 0.6 | 5.2 |

From Table 2, it is found that, in the case where the steel sheet is maintained at a temperature of 650° C. to 950° C. for shorter than 5.0 s or in the case where the steel sheet is maintained at a temperature of 950° C. to 1,050° C. for longer than 80.0 s, the amount of change in grain size number before and after the brazing thermal treatment (the amount of a grain size number changed by the brazing thermal treatment) becomes greater than 5.0. The great change of the grain size number before and after the brazing thermal treatment leads to a great change in the mechanical properties of a stainless steel before and after the brazing thermal treatment, and there is a fear of causing an accident or the like of components, and thus it is desirable to avoid the great change of the grain size number between before and after the brazing thermal treatment. In the present embodiment, when an amount of change in grain size number before and after the brazing thermal treatment is 5.0, the mechanical properties greatly change. Therefore, the amount of change in grain size number before and after the brazing thermal treatment is desirably decreased to 5.0 or less. The amount of change in grain size number before and after the brazing thermal treatment is more desirably 4.0 or less. Since the amount of change in grain size number before and after the brazing thermal treatment is preferably low, it is not necessary to set the lower limit value. However, since it is difficult to set the amount of change in grain size number to zero, the lower limit value is desirably set to more than zero.

In the present embodiment, it was found that, when a Laves phase such as $Fe_2Nb$ is finely precipitated in a steel, this phase serves as a pinning factor, and the amount of change in grain size number before and after the brazing thermal treatment decreases. The temperature at which the Laves phase is precipitated is 650° C. to 950° C., and the temperature at which the Laves phase dissolves is 950° C. to 1,050° C. Therefore, during the annealing of the cold-rolled sheet, it is necessary to maintain the cold-rolled sheet in a temperature range of 650° C. to 950° C. for a long period of time and maintain the cold-rolled sheet in a temperature range of 950° C. to 1,050° C. for a short period of time. In the present embodiment, the annealing step preferably includes a step of maintaining the steel sheet at a temperature of 650° C. to 950° C. for 5.0 s or longer and a step of maintaining the steel sheet at a temperature of 950° C. to 1,050° C. for 80.0 s or shorter. It was found that, in such a case, it becomes possible to sufficiently precipitate the fine Laves phase which is effective for pinning crystal grains. The annealing step more desirably includes a step of maintaining the steel sheet at a temperature of 650° C. to 950° C. for 8.0 s (seconds) or longer and a step of maintaining the steel sheet at a temperature of 950° C. to 1,050° C. for 60.0 s (seconds) or shorter. In addition, when productivity is taken into account, the holding time during which the steel sheet is maintained at a temperature of 650° C. to 950° C. is preferably 50 s or shorter. When the appropriate recrystallization of the structure after cold rolling is taken into account, the holding time during which the steel sheet is maintained at a temperature of 950° C. to 1,050° C. is preferably 10 s or longer.

Hereinafter, the chemical composition of a steel defined in the present embodiment will be described in more detail. Meanwhile, "%" indicates "mass %".

C: Since C degrades intergranular corrosion resistance and workability, it is necessary to decrease the amount of C at a low level. Therefore, the amount of C is set to 0.030%. However, an excessively low amount of C assists the coarsening of crystal grains during brazing and increases refinement costs, and thus the amount of C is desirably set to 0.001% or more. The amount of C is more desirably 0.004% to 0.020%.

Si: Si is a useful deoxidation element, but Si increases the activity of Ti; and thereby, Si assists the generation of a hard Ti-based oxide. Therefore, the amount of Si is set to 0.01% to 1.00%. The amount of Si is more desirably 0.10% to 0.60%.

Mn: Mn is a useful deoxidation element, but in the case where an excess amount of Mn is added, Mn deteriorates corrosion resistance, and thus the amount of Mn is set to 0.01% to 2.00%. The amount of Mn is more desirably 0.10% to 1.00%.

P: P is an element that deteriorates workability and weldability, and thus it is necessary to limit the amount of P. Therefore, the amount of P is set to 0.050% or less. The amount of P is more desirably set to 0.030% or less.

S: S is an element that deteriorates corrosion resistance, and thus it is necessary to limit the amount of S. Therefore, the amount of S is set to 0.0100% or less. The amount of S is more desirably set to 0.0050% or less.

Cr: Examples of possible corrosive environments include atmospheric environments, cooling water environments, exhaust gas-condensate environments, and the like. In order to ensure corrosion resistance in the above-described environments, at least 11.0% or more of Cr is required. As the amount of Cr is increased, the corrosion resistance is improved, but the workability and manufacturability are degraded, and thus the amount of Cr is set to 30.0% or less. The amount of Cr is more desirably 15.0% to 23.0%.

Mo: In order to improve corrosion resistance against condensate water, 0.01% or more of Mo is required. However, in the case where an excess amount of Mo is added, workability is degraded and costs are increased due to the expensive price of Mn, and thus the amount of Mo is set to 3.00% or less. The amount of Mo is more desirably 0.10% to 2.50%.

Ti: Ti forms an oxide film with poor wettability on the surface and degrades brazeability. Therefore, the amount of Ti is set to 0.001% to 0.050%. The amount of Ti is more desirably 0.001% to 0.030%.

Al: Al has a deoxidation effect or the like, Al is a useful element for refinement, and Al has an effect of improving moldability. In order to stably obtain these effects, 0.001% or more of Al is preferably included. However, in the case where a large amount of Al is included, an oxide film with poor wettability is formed on the surface, and brazeability is impaired. Therefore, the amount of Al is set to 0.030% or less. The amount of Al is more desirably 0.001% to 0.015%.

Nb: Since carbonitrides of Nb prevents the coarsening of crystal grains due to heating during brazing and thus a decrease in the strength of members is prevented, Nb is an important element. In addition, Nb is useful for improving high-temperature strength or improving the intergranular corrosion resistance of welded portions, but in the case where an excess amount of Nb is added, workability or manufacturability is degraded, and thus the amount of Nb is set to 0.010% to 1.000%. The amount of Nb is more desirably 0.100% to 0.600%.

O: O is an element that is inevitably included in a stainless steel. In the present embodiment, it is not necessary to particularly limit the amount of O. However, when O is present in the base material of a stainless steel, there is a possibility that O causes the formation of inclusions such as oxides and degrades a variety of characteristics such as ductility or corrosion resistance. Therefore, the amount of O is desirably decreased to be 0.020% or less. The amount of O is more desirably 0.010% or less.

N: N is a useful element for pitting corrosion resistance, but N degrades intergranular corrosion resistance and workability, and thus it is necessary to decrease the amount of N at a low level. Therefore, the amount of N is set to 0.050% or less. The amount of N is more desirably 0.030% or less.

What has been described above is the chemical composition which serves as the basic of the ferritic stainless steel of the present embodiment; however, in the present embodiment, the ferritic stainless steel may further include the following elements as necessary.

Ni: In order to improve corrosion resistance, 3.00% or less of Ni may be included. In order to stably obtain the effects, the amount of Ni needs to be 0.01% or more. The amount of Ni is more desirably 0.05% to 2.00%.

Cu: In order to improve corrosion resistance, 1.500% or less of Cu may be included. In order to stably obtain the effects, the amount of Cu needs to be 0.050% or more. The amount of Cu is more desirably 0.100% to 1.000%.

W: In order to improve corrosion resistance, 1.000% or less of W may be included. In order to stably obtain the effects, the amount of W needs to be 0.010% or more. The amount of W is more desirably 0.020% to 0.800%.

V: In order to improve corrosion resistance, 0.300% or less of V may be included. In order to stably obtain the effects, the amount of V needs to be 0.010% or more. The amount of V is more desirably 0.020% to 0.050%.

Sn: In order to improve corrosion resistance, 0.500% or less of Sn may be included. In the case where Sn is included, the amount of Sn is desirably 0.005% or more at which the effects can be obtained stably. The amount of Sn is more desirably 0.01% to 0.300%.

Sb: In order to improve general corrosion resistance, 0.5000% or less of Sb may be included. In the case where Sb is included, the amount of Sb is desirably 0.0050% or more at which the effects can be obtained stably. The amount of Sb is more desirably 0.0100% to 0.3000%.

Mg: Mg has a deoxidation effect or the like and is a useful element for refinement. In addition, Mg minimizes the structure and Mg is also useful for improving workability and toughness, and 0.0030% or less of Mg may be included as necessary. In the case where Mg is included, the amount of Mg is desirably 0.0001% or more at which the effects can be obtained stably. The amount of Mg is more desirably 0.0001% to 0.001%.

Meanwhile, the total amount of one or more of Ni, Cu, W, V, Sn, Sb, and Mg is desirably 6% or less from the viewpoint of an increase in costs.

B: B is a useful element for improving secondary workability, and 0.0030% or less of B may be included. In the case where B is included, the amount of B is desirably 0.0002% or more at which the effects can be obtained stably. The amount of B is more desirably 0.0005% to 0.0010%.

Ca: Ca is added in order for desulfurization, but in the case where an excess amount of Ca is added, a water-insoluble inclusion CaS is generated and corrosion resistance is degraded. There fore, 0.0002% to 0.0100% of Ca may be added. The amount of Ca is more desirably 0.0002% to 0.0050%.

Zr: In order to improve corrosion resistance, 0.300% or less of Zr may be included as necessary. In the case where Zr is included, the amount of Zr is desirably 0.010% or more at which the effects can be obtained stably. The amount of Zr is more desirably 0.020% to 0.200%.

Co: In order to improve secondary workability and toughness, 0.300% or less of Co may be included as necessary. In the case where Co is included, the amount of Co is desirably 0.010% or more at which the effects can be obtained stably. The amount of Co is more desirably 0.020% to 0.200%.

Ga: In order to improve corrosion resistance and hydrogen embrittlement resistance, 0.0100% or less of Ga may be included as necessary. In the case where Ga is included, the amount of Ga is desirably 0.0001% or more at which the effects can be obtained stably. The amount of Ga is more desirably 0.0005% to 0.0050%.

Ta: In order to improve corrosion resistance, 0.0100% or less of Ta may be included as necessary. In the case where Ta is included, the amount of Ta is desirably 0.0001% or more at which the effects can be obtained stably. The amount of Ta is more desirably 0.0005% to 0.0050%.

REM: Since REM has a deoxidation effect or the like, REM is a useful element for refinement, and 0.200% or less of REM may be included as necessary. In the case where REM is included, the amount of REM is desirably 0.001% or more at which the ctfccts can be obtained stably. The amount of REM is more desirably 0.002° % to 0.100%.

Here, rare earth elements (REM) refer to, according to the ordinary definition, two elements of scandium (Sc) and yttrium (Y) and fifteen (lanthanoid) elements from lanthanum (La) to lutetium (Lu). REM is one or more elements selected from these rare earth elements, and the amount of REM refers to the total amount of rare earth elements.

In a manufacturing method of the present embodiment, basically, an ordinary method for manufacturing a steel sheet made of a ferritic stainless steel is applied. For example, molten steel having the above-described chemical composition is produced using a converter or an electric furnace and is refined using an AOD furnace, a VOD furnace, or the like. After that, a slab is produced using a continuous casting method or an ingot casting method and then the slab is subjected to steps of hot rolling, annealing of hot-rolled sheets, pickling, cold rolling, finishing annealing, and pickling; and thereby, the ferritic stainless steel of the present embodiment is manufactured. The annealing of hot-rolled sheets may not be carried out as necessary. The cold rolling, the finishing annealing, and the pickling may be repeated.

However, as described above, in the cold rolling step, in order to control the surface roughness, steel sheets are desirably rolled using a roll with a roll roughness of #60 or more in the final pass under conditions in which the rolling reduction in the final pass is set to 15.0% or less and the cold rolling speed in the final pass is set to 800 m/min or less. In addition, in order to precipitate the Laves phase such as $Fe_2Nb$ in steel, the annealing step of the cold-rolled sheet desirably includes a step of maintaining the steel sheet at a temperature of 650° C. to 950° C. for 5.0 s or longer and a step of maintaining the steel sheet at a temperature of 950° C. to 1,050° C. for 80.0 s or shorter. That is, in the annealing step, it is desirable to set the holding time during which the steel sheet is maintained at a temperature of 650° C. to 950° C. to 5.0 s or longer and set the holding time during which the steel sheet is maintained at a temperature of 950° C. to 1,050° C. to 80.0 s or shorter.

Examples

The present invention will be described in more detail using examples.

Steels with a composition shown in Tables 3A and 3B was produced, the steels were subjected to hot rolling to a sheet thickness of 4 mm, the steels were annealed at 1,050° C. for one minute, and then the steels were pickled. After that, the steels were ere subjected to cold rolling to a sheet thickness of 1 mm. Particularly, the cold rolling was carried out under conditions where the roll roughness in the final pass of cold rolling, the rolling reduction, and the cold rolling speed were set to the values as shown in Table 3C. In the annealing of cold-rolled sheets, the holding time at a temperature of 650° C. to 950° C. and the holding time at a temperature of 950° C. to 1,050° C. were respectively controlled as shown in Table 3C.

After that, test specimens with a 100 mm width and a 100 mm length were cut out from the produced steel sheets. The arithmetic average roughness values of the steel surface in the respective directions of the rolling direction (L direction), the direction perpendicular to the rolling direction (C direction), and the direction inclined at 45° with respect to the rolling direction (V direction) were measured using a surface roughness and shape measurement instrument. The measurement length was set to 4.0 mm, the measurement speed was set to 0.30 mm/s, and the cut-off length was set to 0.8 mm. In each of the directions, the average value of three measurement results was used as the arithmetic average roughness value in that direction.

In addition, the produced steel sheets were cut so that a surface parallel to the rolling direction could be observed and were implanted in a resin. The grain size number (GSN) was measured using the cutting method.

In addition, test specimens with a 60 mm width and a 100 mm length were cut out from the produced steel sheets, and Ni brazing filler metal (0.2 g) was placed on the surface of each of the test specimens and was heated at 1,200° C. for ten minutes in a vacuum atmosphere of $5\times10^{-3}$ torr. Next, the test specimen was cooled to normal temperature, and an area of the brazing filler metal (brazing filler metal area) on the surface of the test specimen after heating was measured. Test specimens in which the brazing filler metal area after heating was 2.5 times or more the brazing filler metal area before heating was evaluated as A (excellent). Test specimens in which the brazing filler metal area after heating was 2 times (twice) or more to less than 2.5 times the brazing filler metal area before heating was evaluated as B (good). Test specimens in which the brazing filler metal area after heating was less than 2 times (twice) the brazing filler metal area before heating was evaluated as C (bad). After that, the steel sheets which had been subjected to a brazing thermal treatment were cut so that a surface parallel to the rolling direction could be observed and were implanted in a resin. The grain size number (GSN) was measured using the cutting method.

In addition, test specimens with a 25 mm width and a 100 mm length were cut out from the cold-rolled steel sheets, and then all the surfaces of the test specimens were wet-polished using Emery paper of up to #600. These test specimens were evaluated by half-immersion tests.

Imitation condensate water used in the half-immersion tests was produced as described below. An aqueous solution containing 300 ppm of $Cl^-$, 1,000 ppm of $SO_4^{2-}$, and 1,000 ppm of $SO_3^{2-}$ was produced using hydrochloric acid, sulfuric acid, and ammonium sulfite as reagents. After the addition of the reagents, the pH was adjusted to 2.0 using ammonia water; and thereby the imitation condensate water was obtained. A jig was adjusted so that approximately half of the test specimen was immersed in the imitation condensate water at an angle of 55°. The half of the test specimen was immersed in the imitation condensate water using this jig, and the imitation condensate water was heated to 80° C. The test was carried out for 168 hours, and the solution was renewed everyday on week days.

For corrosion evaluation, the maximum corrosion pit depth was used. After the end of the tests, the corroded product was removed using an aqueous solution of diammonium hydrogen citrate, and the depth of the position in which the test specimen was corroded deepest was measured using a focal depth method. With regard to the determination standard in the half-immersion tests, it was confirmed that growth of corrosion pits became significant under these test conditions in the case where the maximum corrosion pit depth was 100 μm. Therefore, 100 μm was used as the boundary value. A steel in which the maximum corrosion pit depth was less than 100 μm was evaluated as B (good). A steel in which the maximum corrosion pit depth was 100 μm or more was evaluated as C (bad).

In addition, specimens implanted in a resin for L cross-section observation were produced using these steel sheets. The specimens were mirror-polished and then were observed using an SEM, and the compositions of inclusions were analyzed by the energy dispersive X-ray spectroscopy (EDS). The results are shown in Tables 3D and 3E. Here, EDS refers to an element analysis method in which a specimen is irradiated with electron beams, characteristic X-rays being generated are detected, and elements constituting a subject and the concentrations thereof are investigated.

TABLE 3A

| | Steel | Chemical composition (mass %) | | | | | | | | | | | | | |
|---|---|---|---|---|---|---|---|---|---|---|---|---|---|---|---|
| | No. | C | Si | Mn | P | S | Cr | Mo | Ti | Al | Nb | O | N | Others | Al/Ti − (8.4Si − 0.78) |
| Invention Example | A1 | 0.009 | 0.26 | 0.29 | 0.023 | 0.0020 | 19.4 | 1.89 | 0.001 | 0.007 | 0.481 | 0.007 | 0.008 | | 5.6 |
| | A2 | 0.006 | 0.19 | 0.18 | 0.024 | 0.0004 | 19.3 | 1.87 | 0.002 | 0.008 | 0.492 | 0.002 | 0.010 | | 3.2 |
| | A3 | 0.013 | 0.52 | 0.46 | 0.030 | 0.0010 | 19.2 | 0.01 | 0.004 | 0.030 | 0.378 | 0.005 | 0.020 | | 3.9 |
| | A4 | 0.009 | 0.30 | 0.29 | 0.030 | 0.0020 | 29.7 | 2.98 | 0.002 | 0.012 | 0.383 | 0.003 | 0.009 | 0.11Ni | 4.3 |
| | A4' | 0.008 | 0.27 | 0.29 | 0.039 | 0.0020 | 20.0 | 1.92 | 0.004 | 0.013 | 0.473 | 0.003 | 0.008 | 2.40Ni, 0.060Cu | 1.8 |
| | A5 | 0.008 | 0.11 | 0.02 | 0.014 | 0.0030 | 11.1 | 2.60 | 0.048 | 0.015 | 0.180 | 0.006 | 0.008 | 0.050W | 0.2 |
| | A6 | 0.005 | 0.30 | 0.29 | 0.016 | 0.0020 | 19.4 | 1.92 | 0.002 | 0.011 | 0.480 | 0.004 | 0.009 | 0.217V, 0.010Sn | 3.8 |
| | A7 | 0.002 | 0.32 | 1.98 | 0.003 | 0.0054 | 29.7 | 0.30 | 0.002 | 0.006 | 0.970 | 0.010 | 0.006 | 0.090V, 0.0540Sb | 1.1 |
| | A8 | 0.008 | 0.29 | 0.29 | 0.026 | 0.0020 | 19.4 | 1.92 | 0.001 | 0.008 | 0.473 | 0.003 | 0.008 | 0.11Ni, 0.400Cu, 0.050V | 6.3 |
| | A9 | 0.003 | 0.94 | 0.29 | 0.022 | 0.0016 | 18.5 | 1.88 | 0.001 | 0.009 | 0.973 | 0.002 | 0.003 | 0.0003Mg | 1.9 |
| | A10 | 0.010 | 0.41 | 0.17 | 0.049 | 0.0013 | 20.6 | 1.15 | 0.003 | 0.013 | 0.630 | 0.006 | 0.030 | 0.0006B, 0.003Ga | 1.7 |
| | A11 | 0.028 | 0.59 | 0.08 | 0.008 | 0.0021 | 18.5 | 1.60 | 0.003 | 0.013 | 0.031 | 0.001 | 0.020 | 0.0004Ca | 0.2 |
| | A12 | 0.006 | 0.23 | 1.01 | 0.032 | 0.0036 | 25.8 | 0.98 | 0.001 | 0.003 | 0.453 | 0.002 | 0.049 | 0.030Zr | 1.8 |
| | A13 | 0.007 | 0.34 | 0.53 | 0.017 | 0.0047 | 13.2 | 0.75 | 0.002 | 0.008 | 0.362 | 0.018 | 0.007 | 0.029Co, 0.006Ta | 1.9 |
| | A14 | 0.006 | 0.45 | 0.42 | 0.024 | 0.0099 | 26.7 | 1.64 | 0.003 | 0.011 | 0.197 | 0.007 | 0.006 | 0.003REM | 0.7 |
| | A15 | 0.003 | 0.24 | 0.56 | 0.022 | 0.0036 | 11.6 | 0.36 | 0.003 | 0.020 | 0.032 | 0.001 | 0.003 | | 5.4 |
| | A16 | 0.006 | 0.32 | 0.42 | 0.011 | 0.0045 | 12.8 | 1.36 | 0.009 | 0.025 | 0.336 | 0.002 | 0.004 | 0.25Ni | 0.9 |
| | A17 | 0.010 | 0.32 | 0.36 | 0.036 | 0.0012 | 13.6 | 1.22 | 0.011 | 0.028 | 0.145 | 0.006 | 0.005 | 0.0014B, 0.0009Ta | 0.6 |
| | A18 | 0.008 | 0.15 | 0.62 | 0.012 | 0.0016 | 14.9 | 2.58 | 0.035 | 0.020 | 0.465 | 0.011 | 0.003 | 0.423Cu, 0.031V | 0.1 |
| | A19 | 0.021 | 0.02 | 0.74 | 0.036 | 0.0063 | 15.8 | 1.36 | 0.011 | 0.014 | 0.398 | 0.006 | 0.009 | 0.372W, 0.227Co | 1.9 |
| | A20 | 0.006 | 0.22 | 0.22 | 0.032 | 0.0058 | 16.2 | 1.59 | 0.012 | 0.028 | 0.567 | 0.005 | 0.012 | | 1.3 |
| | A21 | 0.008 | 0.14 | 0.43 | 0.021 | 0.0029 | 17.0 | 1.89 | 0.026 | 0.014 | 0.842 | 0.007 | 0.013 | 0.002Sn, 0.012REM | 0.1 |
| | A22 | 0.007 | 0.36 | 0.65 | 0.020 | 0.0037 | 20.9 | 2.10 | 0.012 | 0.029 | 0.695 | 0.006 | 0.009 | | 0.2 |

TABLE 3B

| | Steel | Chemical composition (mass %) | | | | | | | | | | | | | |
|---|---|---|---|---|---|---|---|---|---|---|---|---|---|---|---|
| | No. | C | Si | Mn | P | S | Cr | Mo | Ti | Al | Nb | O | N | Others | Al/Ti − (8.4Si − 0.78) |
| Comparative Example | B1 | 0.032 | 0.12 | 0.68 | 0.025 | 0.0020 | 19.6 | 1.94 | 0.002 | 0.009 | 0.381 | 0.014 | 0.009 | | 4.3 |
| | B2 | 0.007 | 1.04 | 0.39 | 0.026 | 0.0014 | 18.2 | 1.88 | 0.002 | 0.009 | 0.384 | 0.010 | 0.003 | | −3.5 |
| | B3 | 0.004 | 0.24 | 2.03 | 0.036 | 0.0009 | 17.6 | 2.07 | 0.003 | 0.014 | 0.496 | 0.006 | 0.004 | 0.16Ni | 3.4 |
| | B4 | 0.006 | 0.21 | 0.22 | 0.054 | 0.0018 | 15.9 | 1.64 | 0.003 | 0.004 | 0.276 | 0.005 | 0.011 | 0.330Cu | 0.3 |
| | B5 | 0.009 | 0.32 | 0.64 | 0.029 | 0.0120 | 23.8 | 0.66 | 0.002 | 0.006 | 0.541 | 0.003 | 0.006 | 0.012Sn | 1.1 |
| | B6 | 0.004 | 0.42 | 0.32 | 0.027 | 0.0051 | 10.5 | 0.86 | 0.001 | 0.003 | 0.064 | 0.002 | 0.007 | 0.0006B | 0.3 |
| | B7 | 0.003 | 0.21 | 0.14 | 0.014 | 0.0030 | 15.3 | 0.00 | 0.001 | 0.002 | 0.360 | 0.002 | 0.012 | 0.0005Ca | 1.0 |
| | B8 | 0.003 | 0.11 | 0.26 | 0.026 | 0.0020 | 16.4 | 0.23 | 0.056 | 0.013 | 0.554 | 0.004 | 0.032 | | 0.1 |
| | B9 | 0.006 | 0.08 | 0.35 | 0.033 | 0.0014 | 17.9 | 0.30 | 0.004 | 0.034 | 0.214 | 0.006 | 0.022 | 0.002REM | 8.6 |
| | B10 | 0.002 | 0.25 | 0.47 | 0.002 | 0.0060 | 18.5 | 0.40 | 0.002 | 0.006 | 0.005 | 0.004 | 0.041 | | 1.7 |
| | B11 | 0.005 | 0.26 | 0.84 | 0.007 | 0.0074 | 20.3 | 0.97 | 0.001 | 0.003 | 0.478 | 0.007 | 0.054 | 0.040V | 1.6 |
| | B12 | 0.008 | 0.31 | 0.94 | 0.024 | 0.0022 | 26.3 | 1.57 | 0.002 | 0.003 | 0.356 | 0.001 | 0.013 | 0.043W | −0.3 |
| | B13 | 0.004 | 0.33 | 0.30 | 0.026 | 0.0016 | 22.4 | 2.11 | 0.002 | 0.002 | 0.341 | 0.002 | 0.012 | | −1.0 |
| | B14 | 0.002 | 0.41 | 0.77 | 0.016 | 0.0094 | 25.3 | 2.55 | 0.002 | 0.005 | 0.286 | 0.003 | 0.019 | 0.0060Sb | −0.2 |
| | B15 | 0.002 | 0.47 | 0.39 | 0.006 | 0.0035 | 23.1 | 0.97 | 0.003 | 0.002 | 0.841 | 0.006 | 0.031 | 0.0002Ga | −2.5 |
| | B16 | 0.007 | 0.51 | 1.28 | 0.032 | 0.0043 | 17.9 | 2.61 | 0.004 | 0.013 | 0.323 | 0.004 | 0.009 | 0.230Co | −0.3 |
| | B17 | 0.002 | 0.58 | 0.93 | 0.031 | 0.0024 | 16.3 | 1.97 | 0.005 | 0.003 | 0.447 | 0.011 | 0.004 | 0.060Zr | −3.5 |

*Underlined values are outside the ranges of the present invention.

TABLE 3C

| | Steel No. | Final pass cold rolling conditions: Roll roughness | Rolling reduction % | Cold rolling speed m/min | Annealing conditions of cold-rolled sheet: Holding time at a temperature of 650° C. to 950° s | Holding time at a temperature of 950° C. to 1,050° s |
|---|---|---|---|---|---|---|
| Invention Example | A1 | #600 | 11.1 | 500 | 8.0 | 75.0 |
| | A2 | #800 | 13.5 | 500 | 10.0 | 45.3 |
| | A3 | #80 | 8.5 | 800 | 9.0 | 65.5 |
| | A4 | #600 | 12.5 | 250 | 8.3 | 52.3 |
| | A4' | #60 | 6.4 | 500 | 8.6 | 65.1 |
| | A5 | #80 | 14.8 | 700 | 13.4 | 72.3 |
| | A6 | #800 | 5.3 | 480 | 12.7 | 40.9 |
| | A7 | #600 | 12.5 | 470 | 11.6 | 53.2 |
| | A8 | #80 | 12.4 | 350 | 10.5 | 49.7 |
| | A9 | #600 | 8.7 | 400 | 9.6 | 60.5 |
| | A10 | #600 | 9.9 | 340 | 5.3 | 26.9 |
| | A11 | #800 | 12.4 | 600 | 14.6 | 71.1 |
| | A12 | #60 | 11.7 | 320 | 17.3 | 39.5 |
| | A13 | #80 | 9.1 | 430 | 10.8 | 79.8 |
| | A14 | #800 | 12.4 | 500 | 7.4 | 65.3 |
| | A15 | #40 | 12.4 | 750 | 6.9 | 43.2 |
| | A16 | #600 | 15.9 | 450 | 8.9 | 42.5 |
| | A17 | #80 | 13.5 | 850 | 12.6 | 68.3 |
| | A18 | #800 | 12.6 | 500 | 4.2 | 75.3 |
| | A19 | #60 | 10.5 | 258 | 16.2 | 83.5 |
| | A20 | #600 | 15.3 | 396 | 4.5 | 42.0 |
| | A21 | #60 | 16.1 | 900 | 4.8 | 86.3 |
| | A22 | #800 | 14.9 | 870 | 14.6 | 90.1 |
| Comparative Example | B1 | #600 | 10.4 | 500 | 6.3 | 56.1 |
| | B2 | #80 | 12.6 | 430 | 7.8 | 73.2 |
| | B3 | #800 | 13.6 | 320 | 15.9 | 46.3 |
| | B4 | #80 | 14.3 | 254 | 10.3 | 35.2 |
| | B5 | #600 | 8.6 | 800 | 12.4 | 54.9 |
| | B6 | #800 | 9.4 | 460 | 9.6 | 50.3 |
| | B7 | #600 | 7.5 | 450 | 12.1 | 26.6 |
| | B8 | #80 | 9.4 | 431 | 11.6 | 36.7 |
| | B9 | #60 | 12.3 | 700 | 17.6 | 46.2 |
| | B10 | #600 | 14.0 | 490 | 20.6 | 50.1 |
| | B11 | #80 | 12.4 | 500 | 14.3 | 55.8 |
| | B12 | #600 | 9.8 | 250 | 9.7 | 67.1 |
| | B13 | #800 | 12.0 | 456 | 8.6 | 63.5 |
| | B14 | #60 | 10.2 | 500 | 16.3 | 20.4 |
| | B15 | #600 | 12.3 | 365 | 15.4 | 78.9 |
| | B16 | #80 | 6.9 | 600 | 13.8 | 71.2 |
| | B17 | #800 | 13.5 | 460 | 10.7 | 64.5 |

40

TABLE 3D

| | Steel No. | Evaluation of brazeability and test results of corrosion: Inclusion | Brazeability | Test results of corrosion | Measurement results of arithmetic average roughness value: $Ra_L$ μm | $Ra_C$ μm | $Ra_V$ μm | $(Ra_L + Ra_C + 2Ra_V)/4$ μm | $(Ra_L + Ra_C - 2Ra_V)/2$ μm | Measurement results of GSN: GSN (before brazing thermal treatment) | GSN (after brazing thermal treatment) | ΔGSN |
|---|---|---|---|---|---|---|---|---|---|---|---|---|
| Invention Example | A1 | Al-based oxide | A | B | 0.14 | 0.16 | 0.16 | 0.16 | −0.01 | 7.2 | 4.2 | 3.0 |
| | A2 | Al-based oxide | A | B | 0.05 | 0.06 | 0.07 | 0.06 | −0.02 | 7.5 | 4.3 | 3.2 |
| | A3 | Al-based oxide | A | B | 0.11 | 0.10 | 0.09 | 0.10 | 0.02 | 7.1 | 4.3 | 2.8 |
| | A4 | Al-based oxide | A | B | 0.13 | 0.17 | 0.18 | 0.17 | −0.03 | 6.5 | 3.2 | 3.3 |
| | A4' | Al-based oxide | A | B | 0.43 | 0.44 | 0.42 | 0.43 | 0.02 | 6.4 | 3.4 | 3.0 |
| | A5 | Al-based oxide | A | B | 0.08 | 0.09 | 0.09 | 0.09 | −0.01 | 7.3 | 3.7 | 3.6 |
| | A6 | Al-based oxide | A | B | 0.03 | 0.04 | 0.02 | 0.03 | 0.02 | 7.6 | 3.0 | 4.6 |
| | A7 | Al-based oxide | A | B | 0.15 | 0.16 | 0.14 | 0.15 | 0.02 | 6.7 | 4.3 | 2.4 |
| | A8 | Al-based oxide | A | B | 0.09 | 0.10 | 0.11 | 0.10 | −0.02 | 6.2 | 4.1 | 2.1 |
| | A9 | Al-based oxide | A | B | 0.18 | 0.19 | 0.12 | 0.15 | 0.07 | 6.3 | 3.0 | 3.3 |
| | A10 | Al-based oxide | A | B | 0.11 | 0.16 | 0.23 | 0.18 | −0.10 | 7.2 | 3.5 | 3.7 |
| | A11 | Al-based oxide | A | B | 0.02 | 0.05 | 0.04 | 0.04 | −0.01 | 6.4 | 3.1 | 3.3 |
| | A12 | Al-based oxide | A | B | 0.41 | 0.45 | 0.47 | 0.45 | −0.04 | 6.4 | 3.2 | 3.2 |
| | A13 | Al-based oxide | A | B | 0.12 | 0.13 | 0.10 | 0.11 | 0.03 | 6.8 | 4.0 | 2.8 |
| | A14 | Al-based oxide | A | B | 0.03 | 0.04 | 0.05 | 0.04 | −0.02 | 7.4 | 3.3 | 4.1 |
| | A15 | Al-based oxide | B | B | 0.53 | 0.51 | 0.49 | 0.51 | 0.03 | 6.8 | 3.2 | 3.6 |
| | A16 | Al-based oxide | B | B | 0.49 | 0.59 | 0.47 | 0.51 | 0.07 | 7.4 | 4.1 | 3.3 |
| | A17 | Al-based oxide | B | B | 0.31 | 0.74 | 0.71 | 0.62 | −0.19 | 7.1 | 3.2 | 3.9 |
| | A18 | Al-based oxide | A | B | 0.05 | 0.03 | 0.03 | 0.04 | 0.01 | 5.9 | 0.8 | 5.1 |

TABLE 3D-continued

| | Evaluation of brazeability and test results of corrosion | | | Measurement results of arithmetic average roughness value | | | | | Measurement results of GSN | | |
|---|---|---|---|---|---|---|---|---|---|---|---|
| Steel No. | Inclusion | Brazeability | Test results of corrosion | $Ra_L$ μm | $Ra_C$ μm | $Ra_V$ μm | $(Ra_L + Ra_C + 2Ra_V)/4$ μm | $(Ra_L + Ra_C - 2Ra_V)/2$ μm | GSN (before brazing thermal treatment) | GSN (after brazing thermal treatment) | ΔGSN |
| A19 | Al-based oxide | A | B | 0.42 | 0.46 | 0.39 | 0.42 | 0.05 | 5.8 | 0.6 | 5.2 |
| A20 | Al-based oxide | B | B | 0.49 | 0.68 | 0.53 | 0.56 | 0.05 | 5.9 | 0.7 | 5.2 |
| A21 | Al-based oxide | B | B | 0.65 | 0.92 | 0.89 | 0.84 | −0.11 | 5.4 | 0.3 | 5.1 |
| A22 | Al-based oxide | B | B | 0.74 | 0.77 | 0.86 | 0.81 | −0.11 | 5.8 | 0.6 | 5.2 |

TABLE 3E

| | | Evaluation of brazeability and test results of corrosion | | | Measurement results of arithmetic average roughness value | | | | | Measurement results of GSN | | |
|---|---|---|---|---|---|---|---|---|---|---|---|---|
| | Steel No. | Inclusion | Brazeability | Test results of corrosion | $Ra_L$ μm | $Ra_C$ μm | $Ra_V$ μm | $(Ra_L + Ra_{C+} 2Ra_V)/4$ μm | $(Ra_L + Ra_C - 2Ra_V)/2$ μm | GSN (before brazing thermal treatment) | GSN (after brazing thermal treatment) | ΔGSN |
| Comparative Example | B1 | Al-based oxide | B | C | 0.12 | 0.13 | 0.13 | 0.13 | −0.01 | 7.1 | 4.3 | 2.8 |
| | B2 | Al-based oxide | B | C | 0.11 | 0.10 | 0.10 | 0.10 | 0.01 | 6.6 | 3.6 | 3.0 |
| | B3 | Al-based oxide | B | C | 0.04 | 0.05 | 0.05 | 0.05 | −0.01 | 6.5 | 3.8 | 2.7 |
| | B4 | Al-based oxide | B | C | 0.09 | 0.10 | 0.11 | 0.10 | −0.02 | 7.2 | 4.1 | 3.1 |
| | B5 | Al-based oxide | B | C | 0.14 | 0.11 | 0.15 | 0.14 | −0.03 | 7.6 | 4.4 | 3.2 |
| | B6 | Al-based oxide | B | C | 0.03 | 0.04 | 0.04 | 0.04 | −0.01 | 7.1 | 3.9 | 3.2 |
| | B7 | Al-based oxide | B | C | 0.16 | 0.16 | 0.14 | 0.15 | 0.02 | 6.3 | 3.0 | 3.3 |
| | B8 | Al-based oxide | C | B | 0.09 | 0.11 | 0.11 | 0.11 | −0.01 | 6.4 | 2.9 | 3.5 |
| | B9 | Al-based oxide | C | B | 0.43 | 0.45 | 0.47 | 0.46 | −0.03 | 6.8 | 4.4 | 2.4 |
| | B10 | Al-based oxide | B | C | 0.12 | 0.13 | 0.13 | 0.13 | −0.01 | 7.3 | 4.1 | 3.2 |
| | B11 | Al-based oxide | B | C | 0.08 | 0.10 | 0.11 | 0.10 | −0.02 | 7.8 | 3.1 | 4.7 |
| | B12 | Ti-based oxide | B | C | 0.14 | 0.12 | 0.15 | 0.14 | −0.02 | 7.5 | 4.3 | 3.2 |
| | B13 | Ti-based oxide | B | C | 0.03 | 0.05 | 0.05 | 0.05 | −0.01 | 7.2 | 3.9 | 3.3 |
| | B14 | Ti-based oxide | B | C | 0.46 | 0.48 | 0.45 | 0.46 | 0.02 | 7.6 | 3.3 | 4.3 |
| | B15 | Ti-based oxide | B | C | 0.14 | 0.12 | 0.13 | 0.13 | 0.00 | 6.8 | 4.1 | 2.7 |
| | B16 | Ti-based oxide | B | C | 0.09 | 0.11 | 0.12 | 0.11 | −0.02 | 6.7 | 3.8 | 2.9 |
| | B17 | Ti-based oxide | B | C | 0.03 | 0.04 | 0.05 | 0.04 | −0.02 | 6.5 | 3.1 | 3.4 |

*Underlined values are outside the ranges of the present invention.

The test results are shown in Tables 3D and 3E. It is found from Table 3D that steels of Invention Examples were excellent in terms of brazeability and corrosion resistance against condensate water. In addition, it is found from Table 3E that, in the case where the amounts of components were outside the ranges of the present embodiment, the corrosion resistance against condensate water deteriorated except for cases in which the amount of Al or Ti was outside the range of the present embodiment. It is found that, in the case where the amount of Al or Ti was outside the range of the present embodiment, brazeability became poor. In addition, it is found that, even when the amounts of the respective components were within the ranges of the present embodiment, in the case where the amounts of Al, Ti, and Si did not satisfy the relationship of Al/Ti=8.4Si-0.78, a hard Ti-based oxide was generated in a steel, voids serving as starting points of pitting corrosion were formed in the inclusion/base material interfaces, and corrosion resistance against condensate water deteriorated.

In addition, in Steel Nos. A1 to A14, the roughness of a roll that was used in the final cold rolling (the final pass of the cold rolling) was set to #60 or more, the rolling reduction in the final pass was set to 15.0% or less, and the cold rolling speed in the final pass P was set to 800 m/min or less. It is found that steels manufactured under the above-described conditions satisfied both $(Ra_L+Ra_C+2Ra_V)/4 \leq 0.50$ and $|(Ra_L+Ra_C-2Ra_V)/2| \leq 0.10$ and brazeability became more favorable. In addition, in Steel Nos. A1 to A14 of Invention Examples, in the annealing step of the cold-rolled sheets, the holding time of the steel sheet at 650° C. to 950° C. was set to 5.0 s or longer, and the holding time of the steel sheet at 950° C. to 1,050° C. was set to 80.0 s or shorter. It is found that, in steels manufactured under the above-described conditions, the amount of change in grain size number before and after the brazing thermal treatment became 5.0 or less.

INDUSTRIAL APPLICABILITY

The ferritic stainless steel with high corrosion resistance against exhaust gas condensate water of the present invention is suitable as members that are used in exhaust gas recirculation apparatuses such as automobile mufflers, exhaust heat recovery devices, and exhaust gas recirculation (EGR) coolers.

The invention claimed is:

1. A ferritic stainless steel, comprising, by mass %:

C: 0.001% to 0.030%;

Si: 0.01% to 1.00%;

Mn: 0.01% to 2.00%;

P: 0.050% or less;

S: 0.0100% or less;

Cr: 11.0% to 30.0%;
Mo: 0.75% to 3.00%;
Ti: 0.001% to 0.026%;
Al: 0.001% to 0.030%;
Nb: 0.010% to 1.000%; and
N: 0.050% or less,
with a remainder being Fe and inevitable impurities,
wherein an amount of Al, an amount of Ti, and an amount of Si (mass %) satisfy Al/Ti≥8.4Si-0.78,
a rolling direction is represented by an L direction, a direction perpendicular to the rolling direction is represented by a C direction, a direction inclined at 45° with respect to the rolling direction is represented by a V direction, and arithmetic average roughness values of a steel surface in the respective directions are respectively represented by $R_{aL}$, $R_{aC}$, and $R_{aV}$ (unit: μm), then $(R_{aL}+R_{aC}+2R_{aV})/4 \leq 0.50$ and $|(R_{aL}+R_{aC}-2R_{aV})/2| \leq 0.10$ are satisfied.

2. The ferritic stainless steel according to claim 1, further comprising, by mass %, any one or more of:
Ni: 0.01% to 3.00%;
Cu: 0.050% to 1.500%;
W: 0.010% to 1.000%;
V: 0.010% to 0.300%;
Sn: 0.005% to 0.500%,
Sb: 0.0050% to 0.5000%,
Mg: 0.0001% to 0.0030%,
B: 0.0002% to 0.0030%;
Ca: 0.0002% to 0.0100%;
Zr: 0.010% to 0.300%;
Co: 0.010% to 0.300%,
Ga: 0.0001% to 0.0100%,
Ta: 0.0001% to 0.0100%, and
REM: 0.001% to 0.200%.

3. The ferritic stainless steel according to claim 2,
wherein an amount of change in grain size number (GSN) before and after a thermal treatment at 1,150° C. for 10 minutes in a vacuum atmosphere of 50 Pa or lower is 5.0 or less.

4. The ferritic stainless steel according to claim 3 which is used in automobile mufflers, exhaust heat recovery devices, and EGR coolers that are automobile parts exposed to exhaust gas-condensate environments.

5. The ferritic stainless steel according to claim 2 which is used in automobile mufflers, exhaust heat recovery devices, and EGR coolers that are automobile parts exposed to exhaust gas-condensate environments.

6. The ferritic stainless steel according to claim 1,
wherein an amount of change in grain size number (GSN) before and after a thermal treatment at 1,150° C. for 10 minutes in a vacuum atmosphere of 50 Pa or lower is 5.0 or less.

7. The ferritic stainless steel according to claim 6 which is used in automobile mufflers, exhaust heat recovery devices, and EGR coolers that are automobile parts exposed to exhaust gas-condensate environments.

8. The ferritic stainless steel according to claim 1 which is used in automobile mufflers, exhaust heat recovery devices, and EGR coolers that are automobile parts exposed to exhaust gas-condensate environments.

* * * * *